US010981260B2

(12) United States Patent
Lindvall et al.

(10) Patent No.: US 10,981,260 B2
(45) Date of Patent: Apr. 20, 2021

(54) ABRASIVE PRODUCT AND A METHOD FOR MANUFACTURING SUCH

(71) Applicant: KWH MIRKA LTD, Jepua (FI)

(72) Inventors: Stefan Lindvall, Jepua (FI); Mats Sundell, Hirvlax / Uusikaarlepyy (FI)

(73) Assignee: KWH MIRKA LTD, Jepua (FI)

( * ) Notice: Subject to any disclaimer, the term of this patent is extended or adjusted under 35 U.S.C. 154(b) by 677 days.

(21) Appl. No.: 15/579,694

(22) PCT Filed: May 25, 2016

(86) PCT No.: PCT/FI2016/050357
§ 371 (c)(1),
(2) Date: Dec. 5, 2017

(87) PCT Pub. No.: WO2016/193534
PCT Pub. Date: Dec. 8, 2016

(65) Prior Publication Data

US 2018/0178351 A1 Jun. 28, 2018

(30) Foreign Application Priority Data

Jun. 5, 2015 (FI) ..... 20155429

(51) Int. Cl.
*B24D 11/04* (2006.01)
*B24D 18/00* (2006.01)
*B24D 11/00* (2006.01)

(52) U.S. Cl.
CPC ..... *B24D 11/04* (2013.01); *B24D 11/005* (2013.01); *B24D 18/0072* (2013.01)

(58) Field of Classification Search
CPC .... B24D 11/04; B24D 11/005; B24D 18/0072
See application file for complete search history.

(56) References Cited

U.S. PATENT DOCUMENTS 6,062,958 A 5/2000 Wright et al.
6,780,096 B1 * 8/2004 Brown ..... B24D 9/006 156/189
2009/0275269 A1 11/2009 Sakairi

FOREIGN PATENT DOCUMENTS

FR 2 699 417 A1 6/1994
JP S58-173462 U 11/1983
JP S59-24965 A 2/1984
RU 48490 U1 10/2005
WO 97/06926 A1 2/1997
(Continued)

OTHER PUBLICATIONS

Oct. 29, 2019 Office Action issued in Russian Patent Application No. 2017146094.
(Continued)

*Primary Examiner* — Pegah Parvini
(74) *Attorney, Agent, or Firm* — Oliff PLC

(57) ABSTRACT

An abrasive product having an abrasive surface, a belt of an abrasive product, a roll of an abrasive product and a method for manufacturing an abrasive product. An abrasive product includes a backing and an abrasive surface. The abrasive surface includes at least a first abrasive area and a second abrasive area, wherein abrasive properties of the first abrasive area are different from abrasive properties of the second abrasive area.

18 Claims, 4 Drawing Sheets

(56) References Cited

FOREIGN PATENT DOCUMENTS

| | | | |
|---|---|---|---|
| WO | 97/06927 | A1 | 2/1997 |
| WO | 2014/131937 | A1 | 9/2014 |

OTHER PUBLICATIONS

Sep. 15, 2015 Office Action issued in Finnish Patent Application No. 20155429.
Dec. 14, 2015 Office Action issued in Finnish Patent Application No. 20155429.
May 5, 2017 Office Action issued in Finnish Patent Application No. 20155429.
Aug. 11, 2016 International Search Report issued in International Patent Application No. PCT/FI2016/050357.
Aug. 11, 2016 Written Opinion of the International Searching Authority issued in International Patent Application No. PCT/FI2016/050357.
Apr. 27, 2017 International Preliminary Report on Patentability issued in International Patent Application No. PCT/FI2016/050357.

* cited by examiner

ABRASIVE PRODUCT AND A METHOD FOR MANUFACTURING SUCH

TECHNICAL FIELD

The application relates to an abrasive product having an abrasive surface. The application also relates to a belt of an abrasive product, a roll of an abrasive product and method for manufacturing an abrasive product.

BACKGROUND

Abrasive product is used for surface treatment. Surface is treated in order to achieve a desired result, which may relate to surface smoothness, roughness, structure or design, for example. Different desired results may require different kind of abrasive products. Several abrasive products and several processing phases may be required in order to get the desired result.

SUMMARY

An object of the application is to simplify surface treatment process. The object is achieved by providing a multi-abrasive product, which enables achieving different abrading results using a single product in a single processing phase.

According to an embodiment an abrasive product comprises a backing and an abrasive surface, wherein the abrasive surface comprises at least a first abrasive area and a second abrasive area, wherein abrasive properties of the first abrasive area are different from abrasive properties of the second abrasive area.

An embodiment comprises a belt of abrasive product according to embodiments. Another embodiment comprises a roll of abrasive product according to embodiments.

According to an embodiment method for manufacturing an abrasive product comprises a backing and an abrasive surface comprising at least two abrasive areas. The method comprises providing a first abrasive area comprising abrasive properties and providing a second abrasive area comprising abrasive properties different from the abrasive properties of the first abrasive area.

An abrasive product may refer to abrasive material and/or an abrasive item and/or an abrasive article. Abrasive material may mean material, which comprises abrasive grains. For example, abrasive film may be called as abrasive material, or a roll of abrasive material may be called as an abrasive item or as an abrasive article.

BRIEF DESCRIPTION OF THE DRAWINGS

In the following embodiments of the invention are described in more details with the accompanying Figures of which.

DETAILED DESCRIPTION OF EMBODIMENTS

Figure 1:
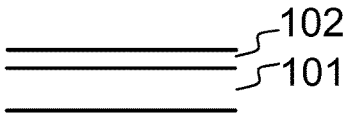
FIG. 1 illustrates a side view of an abrasive product according to an embodiment.

FIG. 1 illustrates a side view of an abrasive product according to an embodiment. The abrasive product comprises a backing 101 and an abrasive surface 102. The backing 101 may comprise one or more layers. The backing 101 may comprise laminated or co-extruded layers. Layer of the backing 101 may comprise similar or different functions, chemical compositions, thicknesses and other properties.

The backing 101 may be flexible. Flexible backing material may comprise thermoplastic, paper, polymer, fabric, cloth foam, laminate or threads. The backing 101 may comprise film, metal film, plastic film, textile, a woven textile made from combustible fibers, a sheet comprising vulcanized fibers. The flexible backing material may conform according to a surface to be abraded. A flexible abrasive product may be an abrasive sheet, disc, roll, belt, band or alike continuous elongated form or part of such. In order to provide a desired flexibility, the backing layer 101 thickness may be from 50 to 250 micrometres, for example.

A polymer material may be suitable material for the backing 101. Polymer material may be laminated or moulded, and processed to a desired shape and thickness. By selecting a suitable polymer material, the backing 101 may be modified to comprise desired properties. The backing 101 may be at the same time both flexible in order to conform with an abraded surface, and durable in order to withstand use in machine abrasion. Durability relates to properties like tensile strength, bending stiffness and/or elongation strength of the backing 101.

The backing 101 may comprise a thermoplastic polymer. Thermoplastic polymers may be processed by extrusion, co-extrusion, injection moulding or lamination. Thermoplastic polymers may be formed to have a precise composition, may be easy to mould and process and may enable providing a backing 101 with even quality. A thermoplastic polymer may be selected to comprise a combination of elastic and plastic properties which are suitable for the abrasive product. The thickness of a thermoplastic polymer backing has an effect on the flexibility of the product. Further, a backing layer comprising the same thickness but a different polymer may have a different property, such as flexibility.

An abrasive surface 102 or an abrasive layer is arranged onto a backing 101. Abrasive surface may comprise abrasive grains adhesively attached to the backing 101 via adhesive. Adhesive may comprise at least one of water based adhesive, solvent based adhesive, acrylic resin or formaldehyde resins. A backing 101 comprising polypropylene has a relatively low surface tension. To promote the attachment of an abrasive surface 102 to the backing 101, a corona, plasma or flame treatment may be used. A corona, plasma or flame treatment increases the surface tension of the treated surface, and may be performed on at least one surface of the backing layer. Alternatively, an adhesion promoting compound may be arranged onto the backing layer 101. Type, concentration and quantity of the adhesion promoting compound may be selected according to the grain size of the abrasive grains to be attached. The adhesion promoting compound may comprise resins, glues and/or varnishes. In particular, the adhesion promoting compound may comprise liquid phenolics or urea resins.

In an embodiment, the backing 101 is arranged to operate as an adhesive. The backing may comprise resin reinforced with fibers. The grains may be partially sunk in a plastic film, or in an organic and/or inorganic coating layer. In an embodiment, the backing 101 may comprise incombustible material, for example metal wires or filler particles.

According to an embodiment two or more abrasive layers may be arranged onto a backing 101. The abrasive surface 102 may comprise several layers. The abrasive layers may have similar size and/or shape, or the size and/or shape of the layers may differ. A fine abrasive layer may be arranged onto a backing 101 and a coarse abrasive layer on top of the fine abrasive layer. Outermost of the abrasive layers may be disintegrated due to mechanical forces, like pressure or shear rate. There may be more abrasive layers on top of each other. An abrasive article with more abrasive layers is less susceptible to wear compared to an abrasive article with a single abrasive layer.

The abrasive grains may be supported by a backing material. The abrasive grains provided on the backing material may be selected for each application, for example according to the composition, grain size or surface treatment. Typical materials used as abrasive grains are hard minerals, which may be synthetic or natural. Minerals used as abrasive grains may comprise cubic boron nitride (c-BN), boron carbide (BC), aluminium oxide ($Al_2O_3$), titanium oxide ($TiO_2$), iron oxide ($Fe_2O_3$), cerium oxide ($CeO_2$), silicon carbide (SiC), zirconia alumina and diamond, such as synthetic diamond grains. In addition or alternatively abrasive grains may comprise ceramic grains or engineered grains.

The abrasive grains may be sized or unsized. Sized means that the grains have a specified average size and/or a specified size distribution. Grains may have average size of 0.1-600 micrometers. The specified size distribution may be relatively narrow. Unsized means that the grains have not been selected according to size. For example grain type may be used as a basis for a selection in addition or instead of grain size.

Abrasive materials may be used in different manufacturing processes for finishing operations to create desired surface finishes. When used for abrasion, an abrasive product comprising abrasive material may last from only a couple of minutes to several hours, depending of the end application. Lifespan for a flexible abrasive product in an industrial use may typically be from few seconds to several minutes.

Figure 2A:
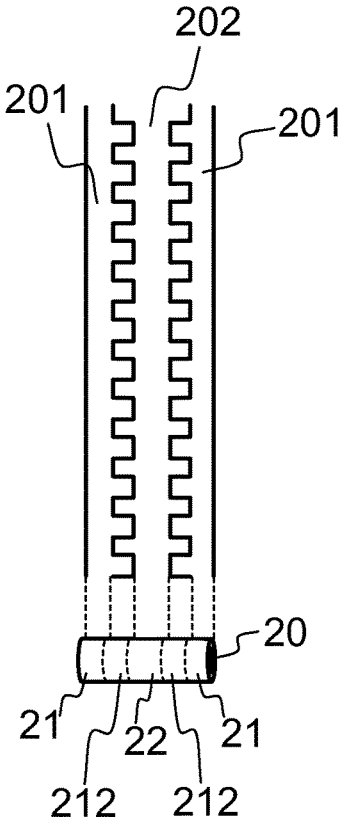
FIG. 2*a* illustrates an abrasive surface of an abrasive product according to an embodiment.

The following FIGS. 2*abc*, 3-5 illustrate embodiments of abrasive surfaces of abrasive products. The abrasive product may be a flexible elongated sheet, which is arranged to be rolled up. The abrasive product may be an abrasive belt. An abrasive surface is arranged onto a backing. The elongated abrasive surface may be arranged next to a surface to be abraded. The abrasive product may be arranged to move, for example from roll to roll, while arranged in contact with the object/surface to be abraded. The object/surface to be abraded may be arranged to move, for example spin, next to the abrasive product.

FIG. 2*a* illustrates an abrasive surface of an abrasive product according to an embodiment. The abrasive surface comprises a first abrasive area 201 and a second abrasive area 202. The first abrasive area 201 may comprise different type of abrasive grains than the second abrasive area 202. In an embodiment, the second abrasive area 202 comprises no abrasive grains. According to the embodiment the second abrasive area 202 has no abrading properties, but it consist of flat surface of the backing material, which may be coated or surface treated. In the embodiment only the first abrasive areas 201 at the side edge portions of the longitudinal abrasive sheet are arranged to abrade, while the middle portion in a transverse dimension of the longitudinal abrasive sheet, between the abrading edge portions, is arranged to be non-abrasive. The abrasive product according to the FIG. 2*a* may be used for example for abrading an axle or a shaft 20, where certain kind of abrading is desired on shaft ends 21, while middle surface portion of the shaft 22 is desired to remain smooth, un-abraded. The shaft is arranged in contact with the abrasive product of FIG. 2*a* such that the second abrasive 202 area of the abrasive product is arranged to contact middle portion of the shaft 22 and to provide the desired abrading result locally on a corresponding surface of the shaft 20. The first abrasive areas 201 are arranged to contact end portions 21 of the shaft and to provide the desired abrading result locally on a corresponding surface of the shaft 20. Borderline of the first and second abrasive areas 201, 202 differs from a direct line along longitudinal direction of the elongated or rolled up abrasive product. Thus on the shaft 20 surface, which is arranged in transverse the elongated or rolled up abrasive product, there is an area 212 that will be treated with properties of the both abrasive areas 201, 202. The abrasive result in the shaft surface 212, between the end 21 and middle surfaces 22, will be abraded with both kind of abrasive areas 201, 202. This kind of semi-abrading area having properties of the both abrading areas next to it, enables avoiding straight boundary or step between the abraded areas 21, 22. Instead, it enables smooth transition between abrading results of the shaft ends 21 and the middle area 22.

A borderline or area between the first abrasive area 201 and the second abrasive area 202 is indirect, for example wavelike or angular, along longitudinal direction of the abrasive product. In the FIG. 2*a* the borderline between the two areas 201, 202 form an angled wave elongating longitudinally along abrasive surface sheet. The area between the two abrasive areas 201, 202 may comprise alternately a surface of the first abrasive area 201 and a surface of the second abrasive area 202, wherein the surfaces are of similar size and shape, for example of squares or rectangular. Edge areas of the abrasive surface comprise abrasive properties of the first kind, as the first abrasive area 201. Middle area of the abrasive surface comprises abrasive properties of the second kind, different from the first kind, as the second abrasive area 202. Between the two different abrasive areas 201, 202, there is a longitudinal area comprising abrasive properties of both the first abrasive area 201 and the second abrasive area 202. Longitudinally the semi-abrasive area consists of both kind: the first abrasive area 201 and the second abrasive area 202. The semi-abrasive area may be divided between the first and the second abrasive areas in suitable ratios. In the FIG. 2*a*, the abrasive areas alternate along longitudinal angled wave, which forms the borderline between the two different areas. This has effect of smoothly changing an abraded surface from the first kind to the second kind. In case of a shaft to be abraded, the edge portions are abraded with the abrasive properties of the first abrasive area and the middle portion of the shaft is abraded with the abrasive properties of the second abrasive area. Between the two, there is no sharp edge, drop or clear line, but the abraded result changes smoothly via semi-abraded area, which has abrading properties of the both neighbouring areas.

An abrasive product surface may comprise a geometric shape, which is repeated along a longitudinal abrasive sheet or web. The repeated geometric shape may be a square or a rectangular. A geometric shape boundary refers to a borderline or contact line between the two transversely adjacent abrasive areas. A boundary is a borderline between two different kind of longitudinally continuing abrasive areas. The geometric shape may be substantially any kind of a geometric shape comprising straight or rounded sides and angles. Geometric shape with angles may also be deformed to obtain congruent or self-similar shape comprising curvature.

Figure 2B:
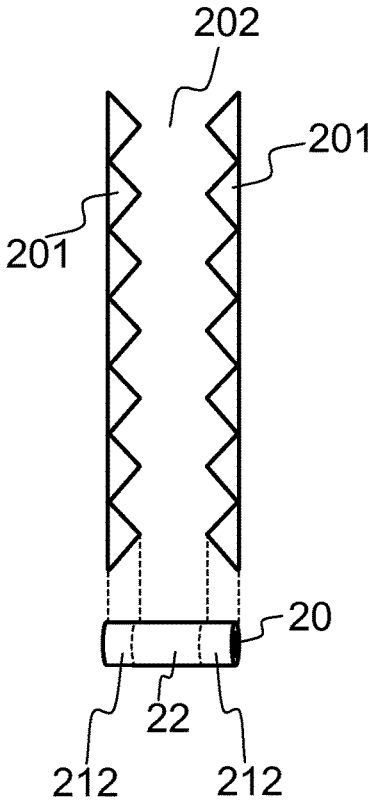
FIG. 2*b* illustrates an abrasive surface of an abrasive product according to an embodiment.

FIG. 2*b* illustrates an abrasive surface of an abrasive product according to an embodiment. The abrasive surface comprises a first abrasive area 201 on external edge portions of the elongated sheet of the abrasive material and a second abrasive area 202 in the middle area of the elongated sheet of the abrasive material. The first abrasive area 201 and the second abrasive area 202 comprise different abrasive properties. For example different type of grains and/or different size of grains and/or grains at different density on an area unit. The first abrasive area 201 and the second abrasive area 202 are next to each other transversely and continue along an longitudinal sheet or web of an abrasive material. Borderline between the abrasive areas 201, 202 is serrated in the FIG. 2*b*. The first abrasive area 201 may comprise repeated triangle shaped areas at the transverse edge portions of the longitudinal abrasive product. Alternatively, edges of the abrasive product may comprise continuous first abrasive area, next to the serrated area. Serrated boundary area between different kind of abrasive areas may comprise relatively wide triangle shape or smaller triangles in more dense arrangement. The abrading result is different, when abraded via the first or the second abrasive areas. The borderline between the two is indirect, serrated in the FIG. 2*b*. This has effect of providing smooth transition between two different kind of abrading results. Another effect is to avoid sharp edges between the adjacent abraded surfaces treated with different abrasive areas. In the FIG. 2*b* a middle portion 22 of a shaft to be abraded will receive abrading result according to properties of the second abrading area 202. Edge portions 212 of the shaft will receive abrading result according to abrading properties of the both first and second abrading areas 201, 202.

Figure 2C:
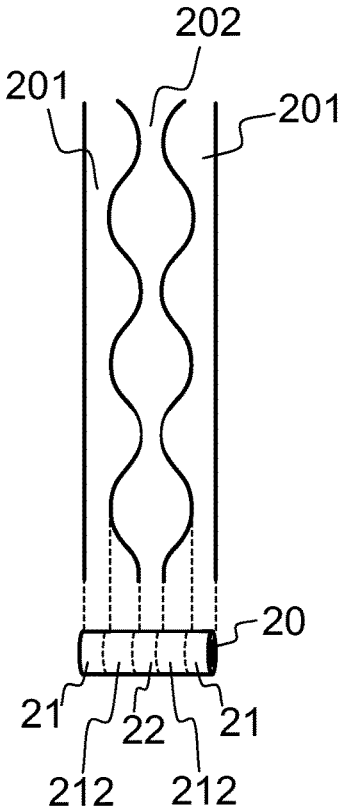
FIG. 2*c* illustrates an abrasive surface of an abrasive product according to an embodiment.

FIG. 2*c* illustrates an abrasive surface of an abrasive product according to an embodiment. A first abrasive area 201 and a second abrasive area 202 have fluctuating wave form borderline between them. In the embodiment of the FIG. 2*c* abrading result on a shaft 20 between the two abrasive areas 201, 202 comprises abrading result 212 having abrading properties of both the first abrasive area 201 and the second abrasive area 202. Accordingly, combined properties of the abrasive areas are used between the different kind of abrasive areas. This has effect of providing continuous abraded surface having at least two different kind of abrasive areas. The different kind of abrasive areas change steplessly from the one kind to another along the abraded surface.

Figure 3:
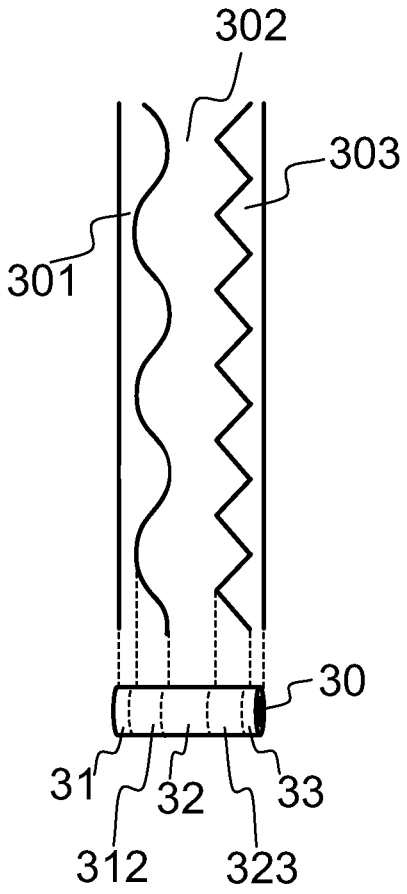
FIG. 3 illustrates an abrasive surface of an abrasive product according to an embodiment.

FIG. 3 illustrates an abrasive surface of an abrasive product according to an embodiment. The abrasive surface comprises three different kind of abrasive areas 301, 302, 303. The abrasive areas 301, 302, 303 may comprise different abrasive properties. Borderline between different kind of abrasive areas is in direct along the longitudinal direction of the elongated abrasive sheet. In the FIG. 3 abrasive areas 301 and 302 share a wavelike borderline between them. Abrasive areas 302 and 303 share a serrated borderline between them. The abrasive product may comprise two, three or more different abrasive areas having different abrasive properties next to each other along transverse direction of the longitudinal abrasive sheet.

Borderline between the areas may comprise similar or different forms. The borderline may differ from a direct line along longitudinal direction of the abrasive sheet in order to provide smooth change between different kind of abrading results. Form of the borderline and density of repeating selected geometry may be designed according to desired result. The abrading result on a shaft 30 comprises a first shaft surface 31 abraded with properties of a first abrasive area 301, a second shaft surface 32 abraded with properties of a second abrasive area 302, a third shaft surface 33 abraded with properties of a third abrasive area 303. A shaft surface 312 between the first shaft surface 31 and the second shaft surface 32 comprises abrasive properties of the first abrasive area 301 and the second abrasive area 302. A shaft surface 323 between the second shaft surface 32 and the third shaft surface 33 comprises abrasive properties of the second abrasive area 302 and the third abrasive area 303.

At least in some embodiments abrasive grains of a first abrasive area have average size of 40 μm and those of a second abrasive area have average grain size of 15 μm. The grain sizes for finishing a formed product may comprise areas parallel next to each other with grains sizes of 40, 20 and 15 μm.

Figure 4:
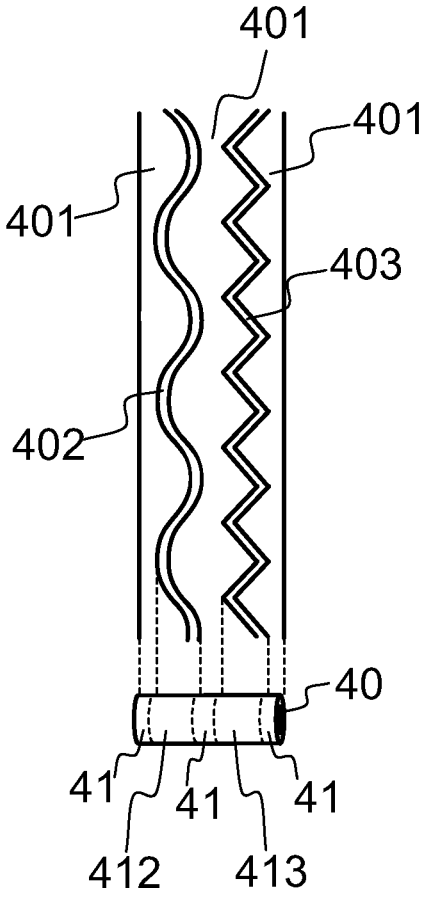
FIG. 4 illustrates an abrasive surface of an abrasive product according to an embodiment.

FIG. 4 illustrates an abrasive surface of an abrasive product according to an embodiment. The abrasive surface comprises a first kind of abrasive surface 401, which may comprise a non-abrasive surface. There is a second kind of abrasive surface 402 having second kind of abrasive properties. In transverse direction of the sheet-like abrasive product the second kind of abrasive surface 402 has on its both sides a first kind of abrasive product.

The abrasive surface 402 is relatively thin compared to the transverse direction of the sheet-like abrasive product. The abrasive surface 402 comprises wavelike borderlines in longitudinal direction of the sheet-like abrasive product, next to the first kind of abrasive surface 401. Similarly a third kind of abrasive surface 403 elongates along longitudinal sheet-like abrasive product, having serrated borderlines with the first kind of abrasive surfaces 401 adjacent to it. An abraded shaft comprises areas 41 treated with the first abrasive area 401. Shaft area 412 comprises properties of the first abrasive area 401 and the second abrasive area 402. Shaft area 413 comprises properties of the first abrasive area 401 and the third abrasive area 403.

Figure 5:
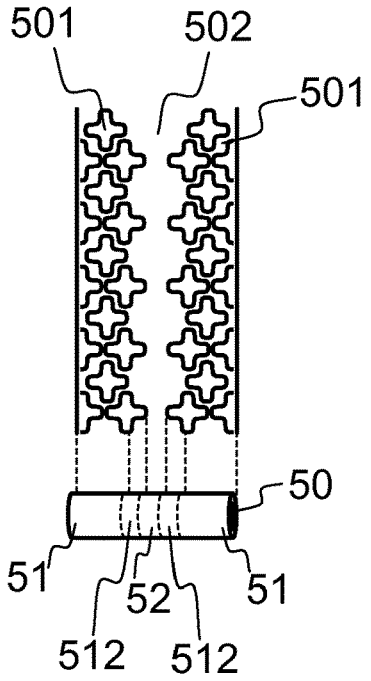
FIG. 5 illustrates an abrasive surface of an abrasive product according to an embodiment.

FIG. 5 illustrates an abrasive surface of an abrasive product according to an embodiment. At least one of a first abrasive area and a second abrasive area comprises form of a fractal. In the FIG. 5 the first abrasive area 501 comprises repeating pattern of abrasive zones. The abrasive zones are arranged next to each other and may form a geometric pattern or a fractal. Fractal consists of similar units, which are repeated. Small units next to each other may form a bigger unit of certain kind. An abrasive product surface may comprise repeating units of abrasive zones, where repeating unit boundaries opposite to each other may have congruent curvature to form a complementary pair to fit the repeating units together. The abrasive zones may be surrounded by channel portions, which may comprise properties of the second abrasive area 502, or another kind of abrasive properties. In the FIG. 5 the abrasive zones of the first abrasive area 501 comprise cross forms, which are repeated next to each other and may be separated by a channel portion. The abrasive zones may have congruent shapes and channel portions may comprise substantially constant widths. The form of the repeating units may vary. The repeating units on the abrasive product surface may comprise self-similar or a congruent shapes. Congruent refers to figures or objects, which have the same shape and size. If the geometric shape is not symmetric, a mirror image of a shape may be used. A mirror image of a shape is also congruent to the original shape. Two congruent shapes may be next to each other in alternating order, for example as translations, rotations and reflections. Self-similar shapes refer to shapes which may differ in size but not in shape. Fractals are self-similar patterns, which may be exactly the same at every scale, or nearly the same at different scales. A two-dimensional surface of the first abrasive area 501 may be created by using the repetition of a geometric shape with no overlaps and no gap. Fractals naturally form a non-straight borderline between the abrasive areas 501, 502. Shape of the borderline depends on the fractals, for example shapes of the fractals. Different kind of fractal structures and accordingly different shapes of borderlines may be utilized.

In previous CBN (cubic boron nitride) is used for grinding a hard steel. Backing material is rigid support, like abrading wheels, which consists of a metal body with a layer of CBN-grains. The layer of CBN-grains may be coated in an electro-galvanic process or sintered or bonded via organic resin(s) with the metal body. The particles stick in a bond specifically designed for grinding with or without coolant. The CBN-grain is of a precise size. However, different kind of abraded results may be desired. For example a shaft with a convex, barrel-like form may be desired instead of a straight shaft. The resulting shaft shall have different diameter at its end portions compared to its middle portion. Deviation between the diameters along the shaft may be relatively small, for example 3-5 μm. The transition from the smaller diameter to the larger diameter shall be smooth and stepless. If CBN technique is utilized, different CBN wheels are needed for each different shaft diameter and shape. Thus multiple wheels are needed in order to achieve a shaft having variations in its diameter and shape. CBN abrading wheels are rather expensive and those wear out during grinding or abrading. When wheels wear during use, those need to be de-grinded back to their original shape. Thus several tools (wheels) and several process phases are required. Whereas with the flexible abrading sheet according to embodiments less tools and process phases are utilized. According to embodiments tooled shaft may be grinded/abraded as a straight shaft of a single diameter along its length with CBN wheels. One wheel may be enough, since it may be moved along the length of the same diameter. Finishing and forming the desired shape with desired local diameters may be implemented using abrasive product according to the embodiments. The abrasive sheet according to embodiments may be used for abrading cylindrical or round objects, like shafts. The abrasive sheet may be provided onto a contact roll, which is arranged to contact with the object to be abraded. At least one or both of the abraded object and the contact roll is arranged to rotate. Abrasive sheet on a roll may be rotated while in contact with a flat surface. Thus round or flat surfaces may be abraded.

Figure 6:
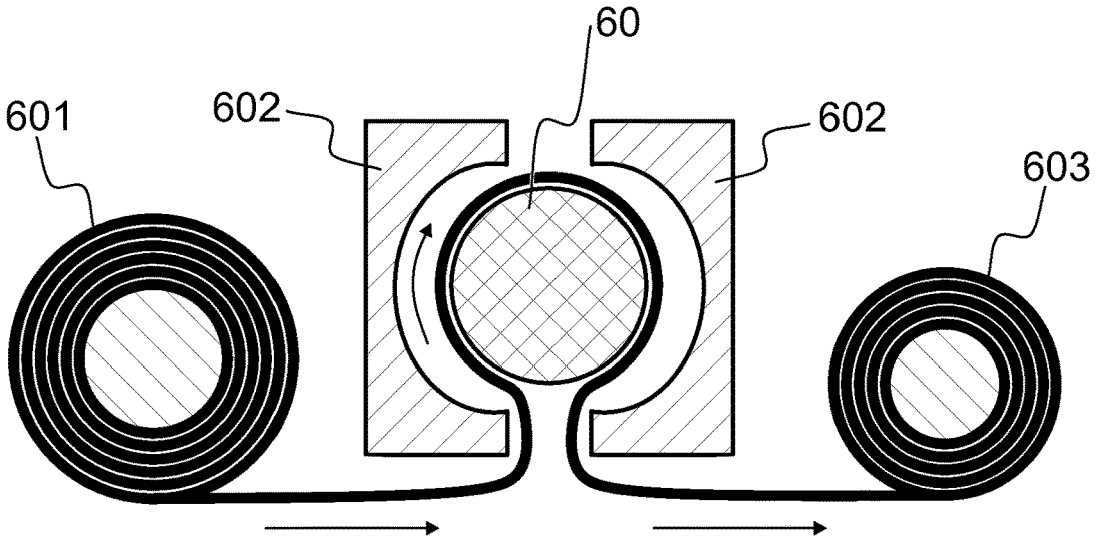
FIG. 6 illustrates roll of an abrasive product according to an embodiment.

FIG. 6 illustrates a roll of an abrasive product according to an embodiment. The abrasive product is flexible material sheet, which is rolled up. The roll 601 of abrasive material is directed next to surface of a product to be abraded, for example a shaft 60. Clamp shoes 602 may be used to keep the abrasive material 601 next to the product to be abraded. The clamp shoes 602 may conform with a product to be tooled 60, like a shaft to be abraded, which is arranged between the clamp shoes 602. Hydraulic cylinders may push the clamp shoes 602 towards the product to be tooled. The abrasive material is arranged next to a clamp shoes 602, between a clamp shoe 602 and the product to be abraded 60, so that abrasive surface faces the product 60. When the clamp shoes 602 are pushed towards the product to be abraded 60, the abrasive surface material is arranged in contact with the product to be abraded 60. The abrasive material comprises at least two separate kind of abrasive areas providing different abrading results. Thus a product 60 between the clamp shoes 602 is abraded with at least two different kind of abrasive surfaces simultaneously. This may enable finishing the product at a single abrading phase.

Abrasive material is fed from a roll 601. When abrasive surface tends to wear out or an original abrasive result is not achieved, worn abrasive sheet is rolled to a roll 603 of used abrasive material, while abrasive material is fed into the clamp in-between the abrading cycles (indexing). The abrasive sheet may be arranged to move from roll to roll in order to arrange abrading. The product 60 may be arranged to roll in order for it to be abraded. It is possible that both, the product 60 and the abrasive product, are arranged to move next to each other.

The abrasive material may be used to form a product, for example for providing a (slightly) convex shaft or a journal a shaft rotating in a bearing. A journal may require oil between a bearing and a moving journal (a shaft inside the bearing). In order to keep the oil between the moving metallic parts, where oil is necessary to avoid breaking the parts, the journal may comprise rough surface, for example threads, at its part which is arranged inside the bearing. The rough surface may be formed next to a smooth surface using the abrasive sheet according to embodiments. This may be implemented with only a few or a single abrading phase and with only a few or a single abrading sheet according to the embodiments. Tolerances of abraded surfaces having certain desired form and/or size are small, for example in order of 0.02-2.0 micrometers. In addition, the abrasive sheet comprising at least two abrasive areas of different abrasive properties may be utilized for providing a desired design as an abrading result.

Abrasive product comprising at least two abrasive areas of different abrasive properties enables providing a surface roughness next to a different surface roughness using a single abrasive product at a single work phase. Abrasive product comprising at least two abrasive areas of different abrasive properties enables forming a product to desired shape, for example convex, using a single abrasive product at a single work phase. In axle shafts, angle structure, like a straight angle between the shafts, is a weak point in the structure. In order to avoid straight angles, the angle portions may be rounded or shaft end portions may be peeled to have low-graded angle. Such rounding an edge portion may be challenging, time-consuming and expensive. Separate peeling is not necessary, but the embodiments enable abrasion of a shaft with an abrasive product comprising at least two areas of different abrasive properties and providing shaft with varying dimension along its length, for example having smaller dimension towards shaft end portions compared to its mid portion. The embodiments enable providing smoothly changing, stepless variation in shaft diameter along the shaft. Convex longitudinal shaft form enables avoiding undesired straight angles between two shafts connected with each other.

The transverse dimension of a longitudinal abrasive product may be substantially constant. An abrasive surface is formed onto a backing. Adhesive may be provided onto the backing and abrasive grains may be provided onto the adhesive. Alternatively, a mix of adhesive and abrasive grains may be provided onto the backing. Abrasive areas of different abrasive properties along transverse dimension of a longitudinal abrasive product may be formed onto a backing by using cylindrical rolls with engravings or printing methods, such as calendaring, gravure or intaglio printing or pressing. Printing enables punctilious manufacturing and smaller tolerances compared to traditional cutting methods. Abrasive material is saved, when used for abrasive parts only, instead of first covering the whole surface, as in prior solutions, and then partly removing extra abrasive from the fully covered surface. Removing extra abrasive area(s) on a surface, like cutting or etching, requires another manufacturing step. In at least some embodiments resulting abrasive product may be fine-tuned and controlled in smaller dimension compared to those made using prior techniques.

Abrasive zones may be provided onto a backing by coating with a kiss roll or an engraved roll. Rotating methods may form a repeating unit along longitudinal abrasive material sheet. Rolls enable repeating certain kind of patterns or densities of adhesive/grains sequentially along longitudinal backing. In a transverse dimension, rolls enable providing for example certain density of adhesive/grains at a certain portion. Rolls may have certain size of holes at certain density in order to provide certain amount of adhesive/grains onto the backing.

Printing may be used to provide different types of shapes or surface patterns onto the backing. Printing may comprise screen printing or other known methods. A pattern of at least one abrasive area may comprise fractal patterns. Printing may be used to provide a surface comprising repeating units. The surface may comprise at least two abrasive areas, which are next to each other transverse dimension of the abrasive sheet and continuous along the longitudinal sheet. Printing method enables producing at least two abrasive areas comprising different abrasive properties onto the backing layer such that the abrasive areas are transversely next to each other and continue along longitudinal abrasive sheet.

Printing methods, like gravure, inkjet or other digital printing methods, may be used for applying adhesive/grains onto the backing. Printing may be used to match the two different abrasive areas and possible area between the two, at their desired places and shapes. Printing may enable providing adhesive areas and areas free of adhesive, as pre-determined. Printing may enable providing two different kind of grain areas along transverse dimension of the longitudinal abrasive sheet. Printing may be used to print adhesive or adhesive zones at certain areas of the backing only. Printing may be used to print adhesive over the entire backing surface with at least two different density of adhesive per areal unit. Printing may be used to print adhesive with at least two different size of adhesive zones at a certain backing area. Printing may be followed by an electrostatic coating of the abrasive grains. In electrostatic coating, majority of the abrasive grains is deposited on places where the field tension is highest. On a surface comprising height deviations, the highest field tension in general is on the elevated areas.

A printing method may comprise two separate printing stations, which may be located next to each other. The two different kind of abrasive areas may be printed simultaneously at the same printing station or sequentially at two separate printing stations. It is possible to print adhesive onto a backing at a first printing station and at the second printing station the grains which are arranged to attach to the applied adhesive. Adhesive may be printed as zones, lines or spots, for example. Size of the adhesive zones or spots has effect on formed abrasive areas. Density of the adhesive determines density of the grain areas. Amount of adhesive may have effect on certain size of grains to/not to become attached. Size of the grains may vary between the two different abrasive zones.

Figure 7:
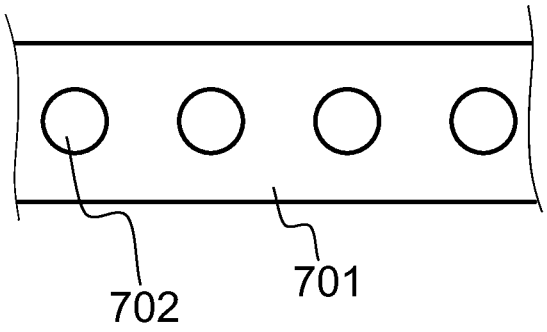
FIG. 7 illustrates an abrasive surface of an abrasive product according to an embodiment.

FIG. 7 illustrates an abrasive surface of an abrasive product according to an embodiment. An abrasive area 702 is provided on a backing 701 such that the abrasive areas 702 form separate areas, separated from each other or surrounded by backing 701 surface, along longitudinal direction of the abrasive product. The backing 701 may be flexible, for example comprise a foamed backing. The abrasive areas 702 may be formed at a certain distance from each other along longitudinal backing material 701. The abrasive areas 702 may form individual spots or enclaves on a backing 701. The abrasive area 702 may have round, circle, oval, rectangular, square or other suitable form, along its edge, which forms a borderline with the backing 701. The abrasive area 702 may comprise two abrasive areas which have different abrasive properties. The two abrasive areas may comprise similar or different shapes. For example, a circular abrasive area 702 may be surrounded by a circular abrasive area comprising wider diameter and different abrasive properties compared to the circular abrasive area 702 in the middle. Borderline between the two abrasive areas may deviate from circle, being for example a wavy circle. According to another example, an angular star-like middle abrasive area may be surrounded by, i.e. placed inside an abrasive area comprising circular circumference. The abrasive area 702 may comprise a through hole, for example in the middle, in order to enhance placing of the product to be abraded.

Separate abrasive areas on a flexible backing may provide a suitable abrading surface for uneven and/or point-like surface to be abraded. The flexible backing is arranged to conform the shape of the surface to be abraded. Separate abrasive areas enable saving abrasive grains compared to fully abrasive covered backing. This may enable savings and effective use of the abrasive material.

Figure 8A:
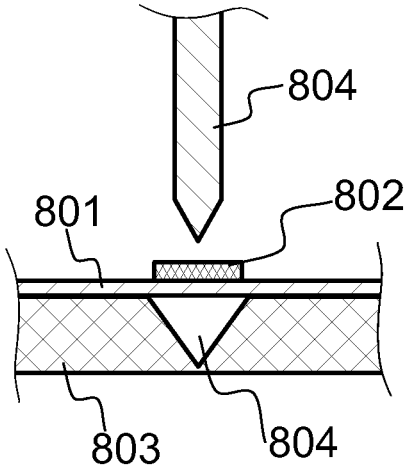
FIG. 8*a* illustrates a flexible abrasive product according to an embodiment.

FIG. 8*a* illustrates a flexible abrasive product according to an embodiment. An abrasive sheet 801 is provided onto a support 803. The support 803 comprises a notch 804. Abrasive area 802 of the abrasive product 801 is arranged next to the notch 804 of the support 803. A product to be abraded 804 is arranged to be pushed against the flexible abrasive area 802, which conforms the shape and size of the product 804 towards the notch 803. The product to be abraded 804 is immersed in the abrasive area 802 of the abrasive sheet 801. This way a roundish end part of the product to be abraded 804 is abraded at its end portion, which is arranged in touch with the flexible abrasive area 802. The abrasive product 804 may be arranged to rotate its sharp end against the abrasive area 802.

A spherical or conical surface may be abraded according to the FIG. 8. For example an injection nozzle(s) may require to be tightly connected to its (their) counterpart(s). Specific geometry is required at its end point, radius and angles. Previously such portions may have been abraded with a longitudinal abrasive material having wave-formed edge, which has softened the edge and enabled the edge part of the abrasive material to raise. According to the embodiment no wave-formed edge is required. Instead the flexible backing enables adjusting according to the form and shape of the product to be abraded.

Figure 8B:
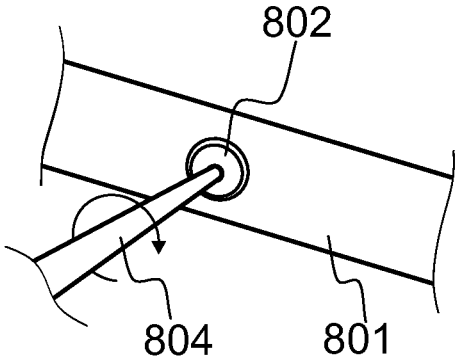
FIG. 8*b* illustrates a flexible abrasive product according to an embodiment.

FIG. 8*b* illustrates a flexible abrasive product according to embodiments. A product to be abraded 804 is pushed next to an abrasive area 802 of an abrasive sheet 801. The product to be abraded 804 is an elongated product. End of the product 804 may have rounded shape. End portion of the product 804 is immersed into abrasive area 802 of the flexible abrasive product 801.

The abrasive area 802 is arranged to adapt to the contours of the abraded surface of product 804. Round end portion is abraded by flexible abrading surface 802 surrounding the round end portion. The arrow illustrates the direction that the product 804 may be moved. The product 804 may be rotated to the opposite direction or to alternating direction against the abrasive surface 802. The product 804 may be rotated around its longitudinal axle, towards the abrasive surface 802 of the flexible abrasive product 801, in which the end portion of the product 804 is immersed.

The abrasive area 802 may comprise two or more abrasive areas within each other. The two or more abrasive areas comprise different abrasive properties. An abrasive area may be surrounded by another abrasive area. Midpoints of the abrasive areas, one inside the other, may concur. Borderline between the two areas may differ from straight line, and instead comprise angular or wavy or alike form.

The invention claimed is:

1. An abrasive product comprising a backing and an abrasive surface on the backing; wherein the abrasive surface comprises at least a first abrasive area, a second abrasive area, and a semi-abrasive area that includes a fluctuating borderline between the first abrasive area and the second abrasive area, abrasive properties of the first abrasive area are different from abrasive properties of the second abrasive area, along a longitudinal dimension of the abrasive product the semi-abrasive area is composed partly of one or more regions of the first abrasive area and partly of one or more regions the second abrasive area, the fluctuating borderline of the semi-abrasive area being a semi-abraded area that has abrading properties of both neighbouring areas.

2. The abrasive product according to the claim 1, wherein the first abrasive area comprises abrasive grain type and/or abrasive grain size and/or abrasive grain density and/or number of successive abrasive layers different from that of the second abrasive area.

3. The abrasive product according to claim 1, wherein the first abrasive area and the second abrasive area are arranged to comprise continuous areas along the longitudinal dimension of the abrasive product.

4. The abrasive product according to claim 1, wherein the fluctuating borderline is selected from a fluctuating wave borderline, a serrated borderline, an angular borderline or a rounded borderline.

5. The abrasive product according to claim 1, wherein at least the first abrasive area and the second abrasive area are arranged parallel with each other along the longitudinal dimension of the abrasive product, optionally a roll of the abrasive product.

6. The abrasive product according to claim 1, wherein the second abrasive area comprises separate areas of similar form and area, at a certain distance from each other, along the longitudinal dimension of the abrasive product, optionally a roll of the abrasive product.

7. The abrasive product according to claim 1, wherein the backing comprises at least one of thermoplastic, paper, film, metal film, textile, foam or laminate.

8. The abrasive product according to claim 1, wherein the abrasive surface comprises abrasive grains attached to the backing via adhesive.

9. The abrasive product according to the claim 8, wherein the adhesive comprises at least one of water based adhesive, solvent based adhesive, acrylic resin, and formaldehyde resins.

10. The abrasive product according to the claim 8, wherein the grains comprise at least one of aluminium oxide, silica carbide, boron nitride, iron oxide, cerium oxide, zirconia alumina, ceramic grain, and diamond.

11. The abrasive product according to claim 1, wherein the first abrasive area comprises at least one of the following compared to the second abrasive area different kind of abrasive grains;

different size of abrasive grains;

different amount of abrasive grains;

different arrangement of abrasive grains; and/or different pattern of abrasive grains.

12. The abrasive product according to claim 1, wherein at least one of the first abrasive area and the second abrasive area comprises fractal pattern of abrasive grains.

13. A belt of the abrasive product according to claim 1.

14. The belt of the abrasive product according to the claim 13, wherein the belt comprises at least two abrasive areas along the longitudinal dimension of the belt, wherein the at least two abrasive areas are arranged next to each other in transverse dimension of the belt.

15. The belt of the abrasive product according to the claim 13, wherein the belt is arranged to form a roll of the abrasive product comprising a backing and an abrasive surface on the backing, wherein the abrasive surface comprises at least a first abrasive area, a second abrasive area, and a semi-abrasive area that includes a fluctuating borderline between the first abrasive area and the second abrasive area, abrasive properties of the first abrasive area are different from abrasive properties of the second abrasive area, along a longitudinal dimension of the abrasive product the semi-abrasive area is composed partly of one or more regions of the first abrasive area and partly of one or more regions the second abrasive area, the fluctuating borderline of the semi-abrasive area being a semi-abraded area that has abrading properties of both neighbouring areas.

16. A method for manufacturing an abrasive product comprising a backing and an abrasive surface on the backing comprising at least two abrasive areas, comprising providing a first abrasive area comprising abrasive properties and providing a second abrasive area comprising abrasive properties different from the abrasive properties of the first abrasive area, wherein the first abrasive area and the second abrasive area are provided such that a semi-abrasive area is formed that includes a fluctuating borderline between the first abrasive area and the second abrasive area, along a longitudinal dimension of the abrasive product the semi-abrasive area is composed partly of one or more regions of the first abrasive area and partly of one or more regions the second abrasive area, the fluctuating borderline of the semi-abrasive area being a semi-abraded area that has abrading properties of both neighbouring areas.

17. The method for manufacturing an abrasive product according to claim 16, comprising providing abrasive grains to the backing using a printing technique, optionally such that the at least two abrasive areas are arranged continuous along the longitudinal dimension of the abrasive product, which is arranged to be rolled up.

18. The method for manufacturing an abrasive product according to claim 16, comprising printing different size of and/or different density of adhesive spots on the first abrasive area compared to the second abrasive area, wherein the adhesive spots are arranged to receive abrasive grains; or printing a mix of adhesive and abrasive grains to the backing.

* * * * *